US007448504B2

(12) United States Patent
Primiano

(10) Patent No.: US 7,448,504 B2
(45) Date of Patent: Nov. 11, 2008

(54) SHELF FOR MAXIMIZING COLD VAULT USE

(75) Inventor: Bernard Primiano, Marietta, GA (US)

(73) Assignee: Display Industries, LLC, Norcross, GA (US)

( * ) Notice: Subject to any disclaimer, the term of this patent is extended or adjusted under 35 U.S.C. 154(b) by 240 days.

(21) Appl. No.: 11/452,440

(22) Filed: Jun. 14, 2006

(65) Prior Publication Data

US 2008/0000852 A1 Jan. 3, 2008

(51) Int. Cl.
*A47F 1/12* (2006.01)

(52) U.S. Cl. ..... 211/59.2; 211/153; 211/181.1; 108/107; 312/45

(58) Field of Classification Search ..... 211/59.2, 211/59.3, 90.01, 90.03, 135, 153, 186, 181.1, 211/188; 312/35, 45, 72, 351; 108/147.11, 108/147.12, 147.13, 147.14, 147.15, 110, 108/107

See application file for complete search history.

(56) References Cited

U.S. PATENT DOCUMENTS 2,581,363 A * 1/1952 Creedon ..... 312/72
2,678,735 A * 5/1954 Crcedon ..... 211/74
3,501,016 A * 3/1970 Eaton ..... 211/74
3,927,769 A * 12/1975 Maslow et al. ..... 211/153
3,970,199 A * 7/1976 Marschak ..... 211/188
4,964,350 A * 10/1990 Kolvites et al. ..... 108/110
5,595,310 A * 1/1997 Spamer et al. ..... 211/59.2
D405,295 S * 2/1999 Bezzerides ..... D6/462
6,015,052 A * 1/2000 Goldberg et al. ..... 211/181.1

* cited by examiner

*Primary Examiner*—Michael Safavi
(74) *Attorney, Agent, or Firm*—John L. James

(57) ABSTRACT

A shelf device for a cooler has a pair of front uprights and a pair of rear uprights. A shelf is attached to uprights is adapted to hold beverage containers in an upright position. Left and right edge portions of the shelf are disposed behind the front uprights and a front edge portion of the shelf is disposed between the front uprights. Left and right guide panels respectively extend from the left and right edge portions toward the front edge portion creating channels for guiding containers from behind the posts for removal.

1 Claim, 2 Drawing Sheets

SHELF FOR MAXIMIZING COLD VAULT USE

TECHNICAL FIELD OF THE INVENTION

This invention relates to a shelf device for a cooler, and more particularly, to a device for more fully utilizing space in the cooler.

BACKGROUND OF THE INVENTION

In a cold vault or other cooler, shelves are used to display containers such as beverage bottles and cans. Gravity feed shelves urge a lead container to the front of the shelf for removal by a consumer. The shelves are attached to vertical upright posts for support and are divided so that the containers are arranged in columns. A column cannot exit behind a post so that there is unused spaced at each side edge of a shelf. While space in a cooler has always been at a premium, it is even more critical today. Energy conservation concerns require a more efficient use of the cooled space in a cooler. It is desirable to have a shelf device for a cooler that utilizes previously unused space.

SUMMARY OF THE INVENTION

The present invention is directed to overcoming one or more of the problems set forth above. Briefly summarized, according to one aspect of the present the invention, a shelf device for a cooler comprises an upright left front frame member and an upright right front frame member spaced from the left front frame member, and an upright left rear frame member and an upright right frame member spaced from the left rear frame member. The left front frame member is also spaced from the left rear frame member, and the right front frame member is also spaced from the right rear frame member. A shelf, attached to the front and rear frame members, has a central panel, a front edge portion extending transversely from the central panel through a space between the left and right front frame members, a rear edge portion extending transversely from the central panel through a space between the left and right rear frame members, a left edge portion extending laterally from the central panel through a space between the left front frame member and the left rear frame member, and a right edge portion extending laterally from the central panel through a space between the right front frame member and the right rear frame member. A left guide panel extends from the left edge portion toward the front edge portion creating a left diagonal channel, and a right guide panel extends from the right edge portion toward the front edge portion creating a right diagonal channel.

The diagonal channels form a pathway for containers from behind the upright posts to the front of the shelf for removal. Prior to moving through the diagonal channels, containers reside in the space between posts that was heretofore not used for containers.

These and other aspects, objects, features and advantages of the present invention will be more clearly understood and appreciated from a review of the following detailed description of the preferred embodiments and appended claims, and by reference to the accompanying drawings

DETAILED DESCRIPTION OF THE PREFERRED EMBODIMENTS

Figure 1:
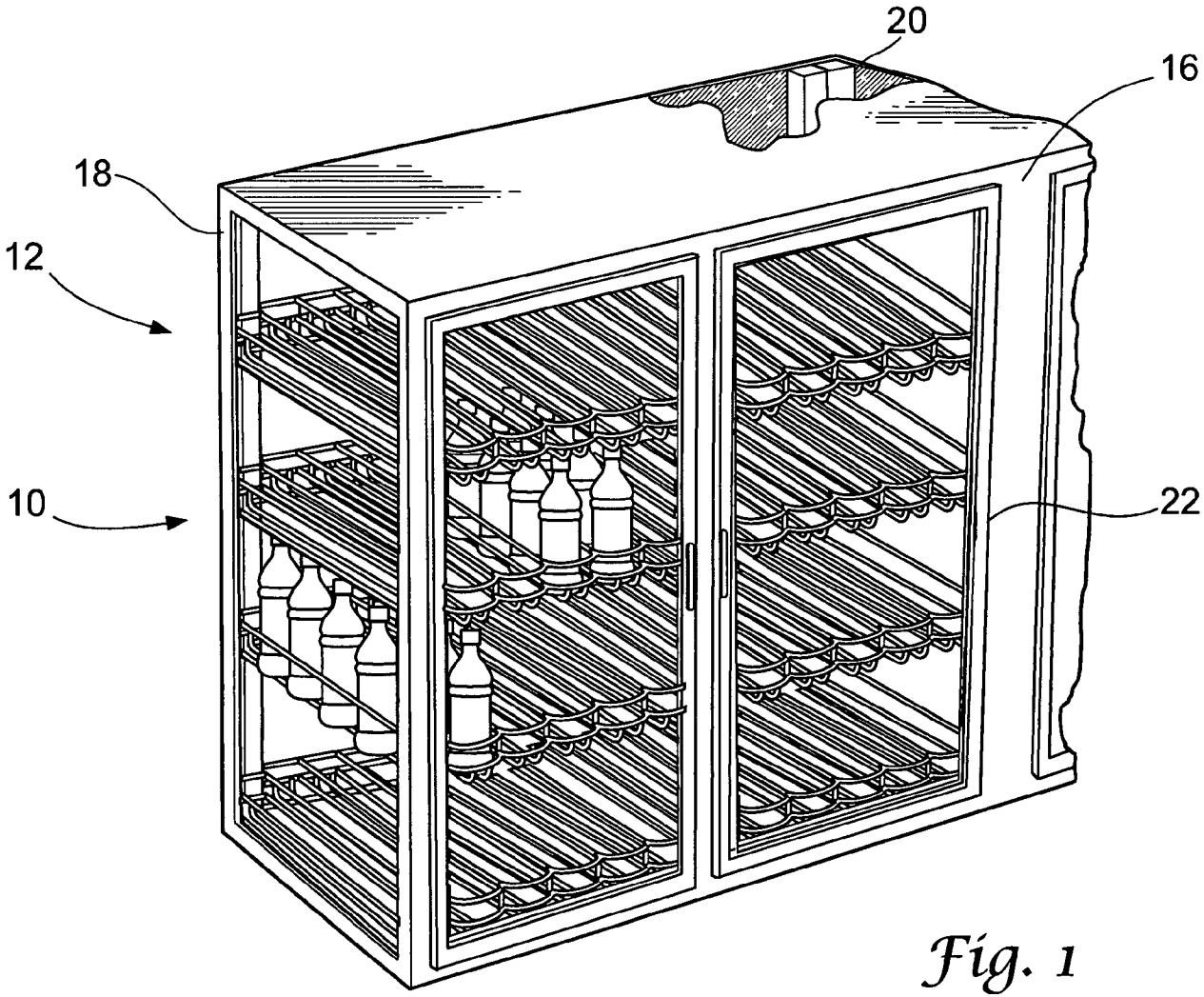
FIG. 1 is a perspective view of a preferred embodiment of a cooler with energy conserving shelves according to the present invention.
Figure 2:
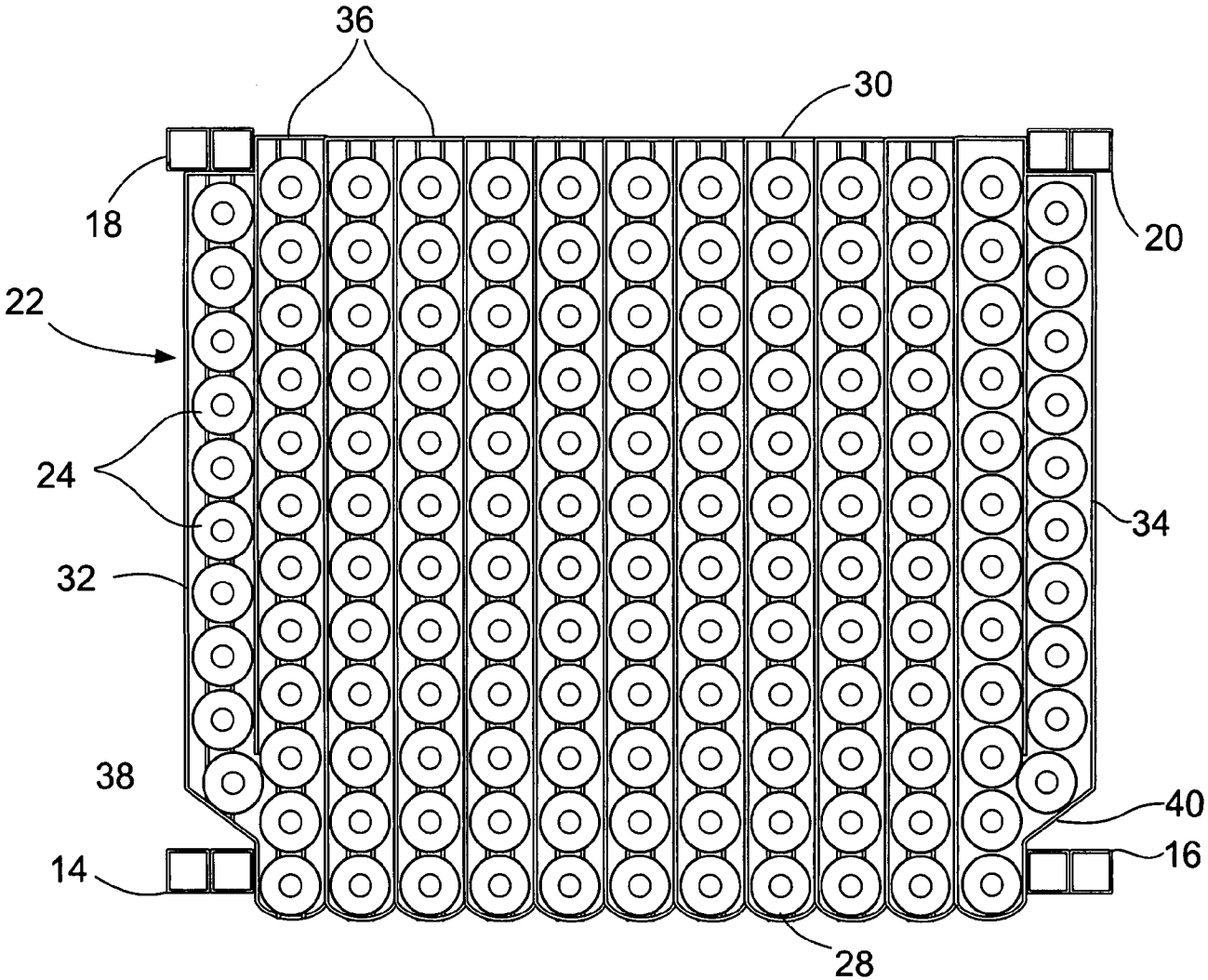
FIG. 2 is a sectional view taken along line 2-2 of FIG. 1 of a shelf and beverage containers.

Referring to FIGS. 1-2, a shelf device 10 for a cooler 12 has a frame comprised of upright members. There is an upright left front frame member 14 and an upright right front frame member 16 spaced from the left front frame member 14. There is also an upright left rear frame member 18 and an upright right frame member 20 spaced from the left rear frame member 18. Left front frame member 14 is spaced from left rear frame member 18 and right front frame member 16 is spaced from right rear frame member 20. There are thus front and rear pairs of upright frame members and left and right pairs of upright members.

A shelf 22 is attached to the front and rear frame members for holding containers 24 in an upright position. Shelf 22 has a central panel 26, and a front edge portion 28 extending transversely from the central panel 26 through a space between the left and right front frame members 14, 16. A rear edge portion 30 extends transversely from the central panel 26 through a space between the left and right rear frame members 18, 20. A left edge portion 32 extends laterally from the central panel 26 through a space between the left front frame member 14 and the left rear frame member 18. A right edge portion 34 extends laterally from the central panel 26 through a space between the right front frame member 16 and the right rear frame member 20.

Shelf 22 is divided into channels 36 which arrange containers 24 into columns extending from front to rear on the shelf. A left guide panel 38 extends from the left edge portion 32 toward the front edge portion 28 creating a left diagonal channel. The left diagonal channel directs containers on left edge portion 32 behind left front frame member 14 into the left main channel for exiting between front frame members 14, 16. A right guide panel 40 extends from the right edge portion 34 toward the front edge portion 28 creating a right diagonal channel. The right diagonal channel directs containers on right edge portion 34 behind right front frame member 16 into the right main channel for exiting between front frame members 14, 16.

While the invention has been described with particular reference to the preferred embodiments, it will be understood by those skilled in the art that various changes may be made and equivalents may be substituted for elements of the preferred embodiments without departing from invention. As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

ELEMENT LIST

10 shelf device
12 cooler
14 upright left front frame member
16 upright right front frame member
18 upright left rear frame member
20 upright right frame member
22 shelf
24 containers
26 central panel

28 front edge portion
30 rear edge portion
32 left edge portion
34 right edge portion
36 channels
38 left guide panel
40 right guide panel

What is claimed is:

1. A shelf device for a cooler, comprising:

an upright left front frame member and an upright right front frame member spaced from said left front frame member;

an upright left rear frame member and an upright right frame member spaced from said left rear frame member, said left front frame member being spaced from said left rear frame member, said right front frame member being spaced from said right rear frame member;

a shelf attached to said front and rear frame members and having a plurality of channels for holding containers in an upright position in columns, said shelf having a central panel, a front edge portion extending transversely from said central panel through a space between said left and right front frame members, a rear edge portion extending transversely from said central panel through a space between said left and right rear frame members, a left edge portion extending laterally from said central panel through a space between said left front frame member and said left rear frame member, and a right edge portion extending laterally from said central panel through a space between said right front frame member and said right rear frame member;

a left guide panel extending from said left edge portion toward said front edge portion creating a left diagonal channel behind said left front frame member for directing containers from a leftmost channel of said plurality of channels to an adjacent channel; and a right guide panel extending from said right edge portion toward said front edge portion creating a right diagonal channel behind said right front frame member for directing containers from a rightmost channel of said plurality of channels to an adjacent channel.

* * * * *